United States Patent [19]

Kitamura

[11] Patent Number: 4,842,208

[45] Date of Patent: Jun. 27, 1989

[54] METHOD AND APPARATUS FOR MANUFACTURING WOUND CORE

[75] Inventor: Fumio Kitamura, Chino, Japan

[73] Assignee: Kitamura Kiden Co., Ltd., Japan

[21] Appl. No.: 137,255

[22] Filed: Dec. 23, 1987

[30] Foreign Application Priority Data

Dec. 29, 1986 [JP] Japan ..... 61-315841
Dec. 29, 1986 [JP] Japan ..... 61-315842

[51] Int. Cl.[4] ..... B65H 35/02
[52] U.S. Cl. ..... 242/56.2; 242/7.12; 29/605; 29/564.7; 72/16
[58] Field of Search ..... 29/605, 564.7; 72/16; 242/7.12, 7.07, 56.2, 56.7

[56] References Cited

U.S. PATENT DOCUMENTS 4,403,489 9/1983 Munsterman et al. ..... 72/16
4,580,336 4/1986 Kevley et al. ..... 29/605
4,622,835 11/1986 Bisson et al. ..... 72/16

FOREIGN PATENT DOCUMENTS 55-132027 10/1980 Japan .
60-28375 7/1985 Japan .
61-22851 6/1986 Japan .

*Primary Examiner*—Carl E. Hall
*Attorney, Agent, or Firm*—Merchant, Gould, Smith, Edell, Welter & Schmidt

[57] ABSTRACT

When a wound core is manufactured by winding a continuous strip having a desired shape on a winding spool, a thickness of the strip is measured and summed at predetermined periods. The winding operation of the strip on the winding spool is stopped when the summed thickness has reached a predetermined value.

12 Claims, 11 Drawing Sheets

METHOD AND APPARATUS FOR MANUFACTURING WOUND CORE

BACKGROUND OF THE INVENTION

1. Field of the Invention

The present invention relates to a method and apparatus for manufacturing a wound core of a transformer.

2. Description of the Related Art

As the iron cores of transformers, wound cores in which a strip having excellent magnetic characteristics is wound in a ring shape are now used. For example, a wound core is obtained by winding a strip material on a winding spool to obtain a square, rectangular, stepwise, or circular cross-section. For this wound core, two split cylindrical coil bobbins are pressure welded at pressure welding faces thereof, and windings are wound on the coil bobbins. Also, a cut-core type is known in which a core is cut and separated at the leg portions thereof, and windings are inserted from the leg portions into the core, to complete a wound core.

When manufacturing the above-mentioned wound core, a strip having a predetermined shape is wound on a winding spool, and as a result, when the winding thickness of the winding spool reaches a predetermined thickness, this winding operation is stopped, and a wound core is obtained. In this case, if the winding thickness is too large, when pressure welded coil bobbins are applied to the wound core and rotated, the wound core scratches the inner surface of the coil bobbins, thereby seriously hindering the winding operation of windings. Also, sometimes it is impossible to perform the pressure welding operation because the coil bobbins have split into two pieces and cannot be joined together again. Conversely, if the winding thickness is too small, a large air gap is formed between the coil bobbins and the wound core, and thus the effective cross section is reduced, and accordingly, the amount of magnetic flux is reduced.

In prior art, the above-mentioned thickness is determined by a predetermined number of rotations of the winding spool. In this case, since the thickness of the strips is not always the same, this predetermined number may be larger than a desired value. Accordingly, when the winding spool has rotated a predetermined number of rotations, the thickness of a strip wound on the winding spool is actually measured, and it is then determined whether the winding operation should be continued or a part of the already wound strip removed. As a result, the efficiency of the winding of the wound cores is lowered and the loss of material is increased, thus increasing the cost of manufacturing the transformers (wound cores).

Similarly, when manufacturing a strip having a predetermined shape from a material having two straight edges, i.e., on both sides thereof, the material is cut by a slitter unit into a plurality of pieces of continuous strip for each core, this strip is wound on a temporary winding frame, and subsequently, the strip is wound on the winding spool, as explained above. In this case, since the width of the cut strip is not automatically controlled in accordance with the thickness of the strip, it is substantially impossible to obtain an absolutely precise predetermined cross section, such as a circular cross section, after the strip is wound on the winding spool. As a result, the effective cross section of the wound core is unsatisfactory, and therefore, the amount of magnetic flux is reduced, thus lowering the performance of the wound core.

SUMMARY OF THE INVENTION

Therefore, an object of the present invention is to enhance the efficiency of the winding of wound cores on winding spools, and reduce the loss of material, thus reducing the cost of manufacturing the transformers (wound cores).

Another object of the present invention is to accurately obtain a predetermined cross section of a wound core after the strip is wound on the winding spool.

According to the present invention, when a wound core is manufactured by winding a continuous strip having a predetermined shape on a winding spool, a thickness of the strip is measured and summed at predetermined periods. The winding of the strip on the winding spool is stopped when the summed thickness reaches a predetermined value.

Also, according to the present invention, the strip is cut from a material in accordance with the summed thickness of the strip wound on the winding spool.

Further, the cutting of a material into a strip and the winding of the strip on a winding spool are simultaneously carried out in accordance with the summed thickness of the strip wound on the winding spool.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

First, examples of wound cores will be explained with reference to FIGS. 1, 2, 3, 4, 5, 6A, and 6B.

Figure 1:
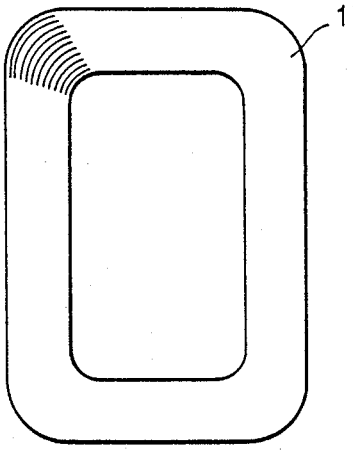
Fig. 1 PRIOR ART
FIGS. 1 and 2 are schematic views of prior art wound cores.
Figure 2:
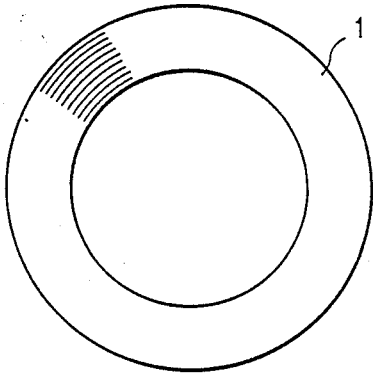
Fig. 2 PRIOR ART
Figure 4:
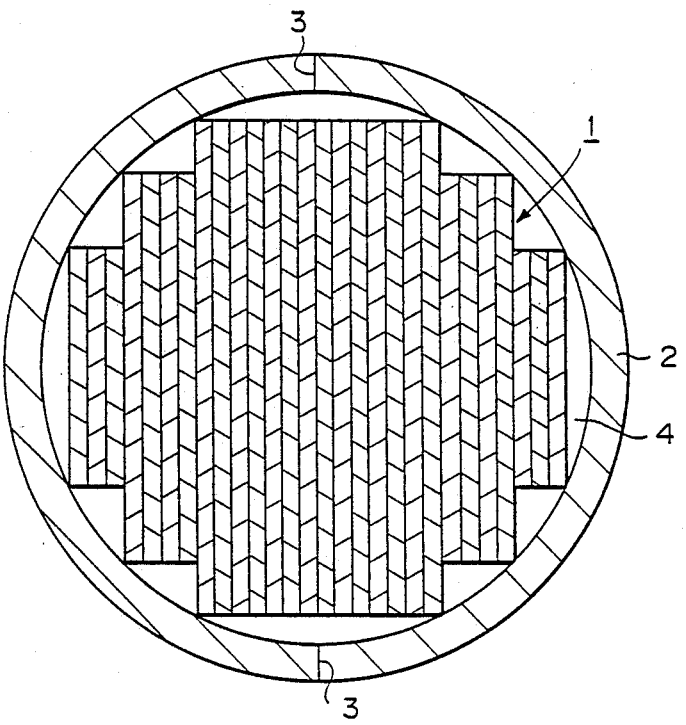
Fig. 4 PRIOR ART
Figure 5:
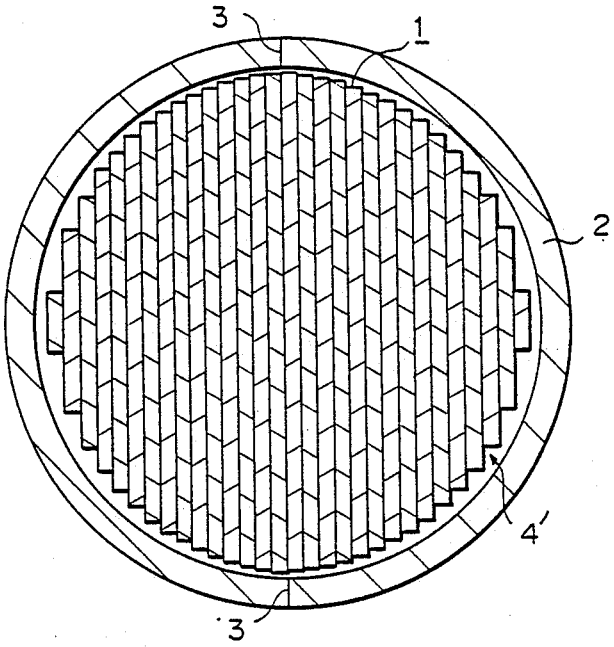
Fig. 5 PRIOR ART

In FIGS. 1 and 2, a wound core 1 is obtained by winding a strip material having excellent magnetic characteristics, which material is cut in advance to a predetermined shape. That is, the cross section of the wound core 1 is square (FIG. 3), rectangular, stepwise (FIG. 4), or circular (FIG. 5). For this wound core 1, two split pieces forming a cylindrical coil bobbin 2 are pressure welded at pressure welding faces 3, and the windings (not shown) are wound onto the coil bobbin 2 by rotation. Therefore, in this case, an air gap 4 or 4' (FIGS. 3, 4, and 5) between the wound core 1 and the coil bobbin 2 is reduced, thus obtaining excellent magnetic characteristics. Also known is a cut-core type in which a core is cut and separated at the leg portions thereof, into which the windings are to be inserted, and the windings are inserted therein, to thereby complete the core.

Figure 6:
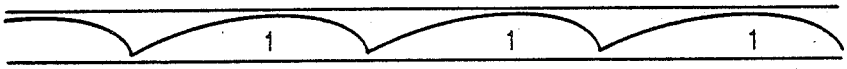
Fig. 6 A PRIOR ART
FIGS. 6A and 6B are plan views of a continuous strip for the wound core of FIG. 5.
Figure 6:
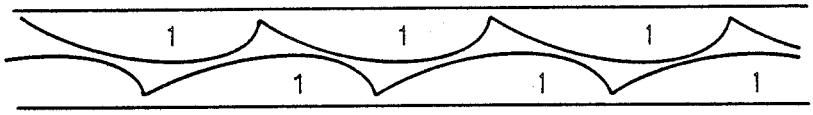
Fig. 6 B PRIOR ART

For example, a plurality of pieces of a continuous strip for the wound core 1 are as illustrated in FIGS. 6A and 6B. That is, one or more pieces of strip are cut from a material having two straight edges, i.e., on both sides thereof. Note that, in practice, the length of a strip piece for one wound core 1 is very long, for example, about 20 m, but the width thereof is very small, for example, about 1 to 3 cm.

Figure 3:
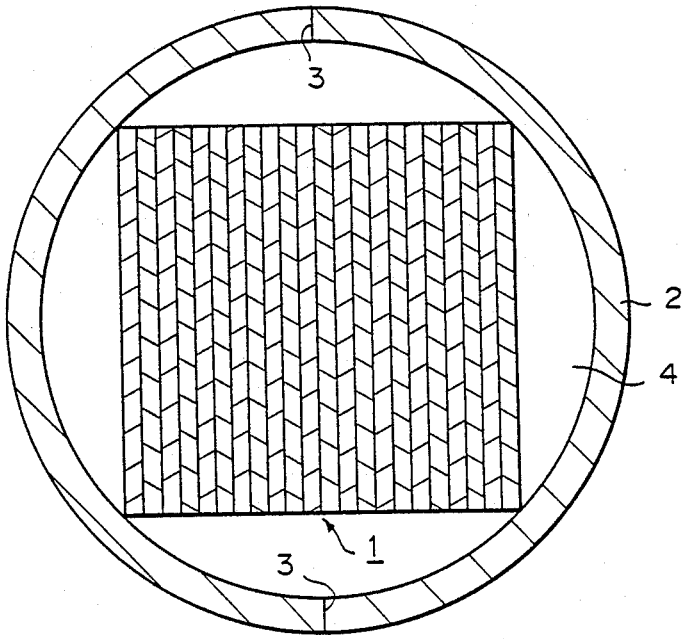
Fig. 3 PRIOR ART
FIGS. 3, 4, and 5 are cross-sectional views of prior art wound cores.
Figure 7:
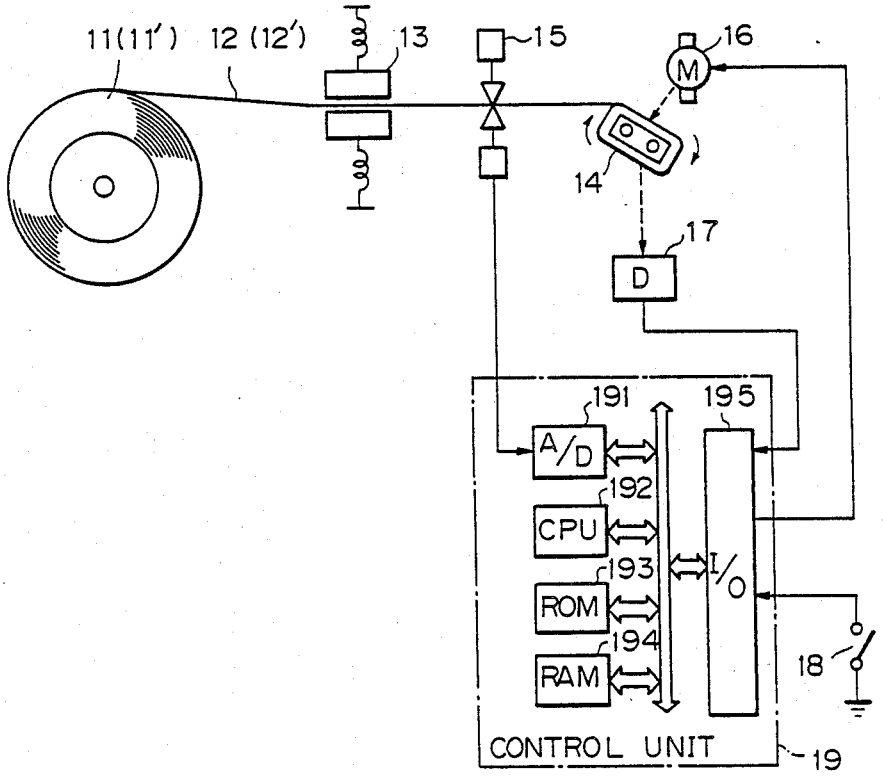
FIG. 7 is a schematic view illustrating a first embodiment of the apparatus for manufacturing a wound core according to the present invention.

In FIG. 7, which illustrates a first embodiment of the present invention, a material or strip is wound on a winding spool, thus completing one wound core. In this case, the material is used for manufacturing a wound core as illustrated in FIG. 3, and the strip is used for manufacturing a wound core as illustrated in FIGS. 4 or 5. In FIG. 7, a material 12 (or a strip 12') is supplied from a material coil 11 (or a temporary winding frame 11'), via a tension adjusting mechanism 13, to a winding spool 14. Reference 15 designates a thickness meter for measuring the thickness of the material 12 (or the strip 12'), which meter is, for example, a differential transformer type meter or an electrostatic capacity type meter. The output of the thickness meter 15 is supplied to an analog/digital (A/D) converter 191 of a control unit 19. Reference 16 designates a drive motor for driving the winding spool 14, and 17 designates a rotational position detector for detecting a predetermined rotational angle position of the winding spool 14. The drive motor 16 and the detector 17 are connected to an input/output interface 195 of the control unit 19. Further, reference 18 designates a start switch for the drive motor 18, which switch is also connected to the input/output interface 195 of the control unit 19.

The control unit 19, which may be constructed by a microcomputer, includes a central processing unit (CPU) 192, a read-only memory (ROM) 193 for storing programs, tables (maps), constants, etc., a random access memory (RAM) 194 for storing temporary data, and the like, in addition to the A/D converter 191 and the input/output interface 195.

The operation of the control unit 19 of FIG. 7 will be explained with reference to the flowcharts of FIGS. 8 and 9.

Figure 8:
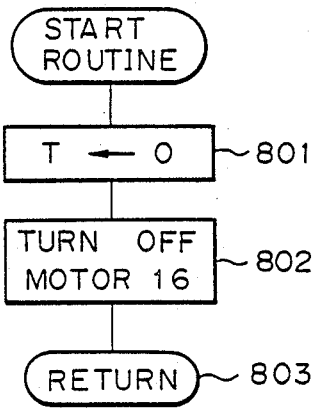
FIGS. 8 and 9 are flowcharts explaining the operation of the control unit of FIG. 7.

The routine of FIG. 8 is an interrupt routine which is started by turning ON the start switch 18. At step 801, a summed thickness T is cleared, then at step 802, the drive motor 16 is turned ON, and this routine is completed at step 303. The winding spool 14 is then rotated as indicated by the arrows in FIG. 7, thus initiating the winding of the material 12 (or the strip 12').

Figure 9:
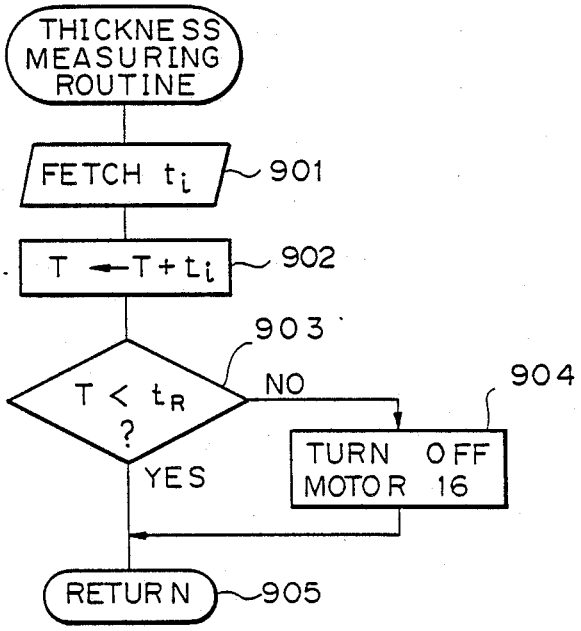

As explained above, when the winding operation of the material 12 (or the strip 12') is carried out, the rotational position detector 17 generates a detection pulse signal, to carry out an interrupt routine shown in FIG. 9. That is, the routine of FIG. 9 is carried out at every one revolution of the winding spool 14.

In the routine of FIG. 9, at step 901, an A/D conversion is performed upon the output $t_i$ of the thickness meter 15, and at step 902, the summed thickness T is renewed by $$T \leftarrow T + t_i.$$

Then, at step 903, it is determined whether or not the summed thickness T has reached a predetermined value $t_R$. As a result, if $T < t_R$, the control proceeds directly to step 905, and if $T \geqq t_R$, the control proceeds to step 904 and the drive motor 16 is turned OFF, and this routine is completed at step 905. Thus, when the summed thickness T of the material 12 (or the strip 12') wound on the winding spool 14 reaches the predetermined value $t_R$, the winding operation by the winding spool 14 is stopped.

After the winding operation of the winding spool 14 is stopped, the material 12 (or the strip 12') is cut manually or automatically, and a complete wound core is obtained as shown in FIGS. 1 or 2.

Figure 10:
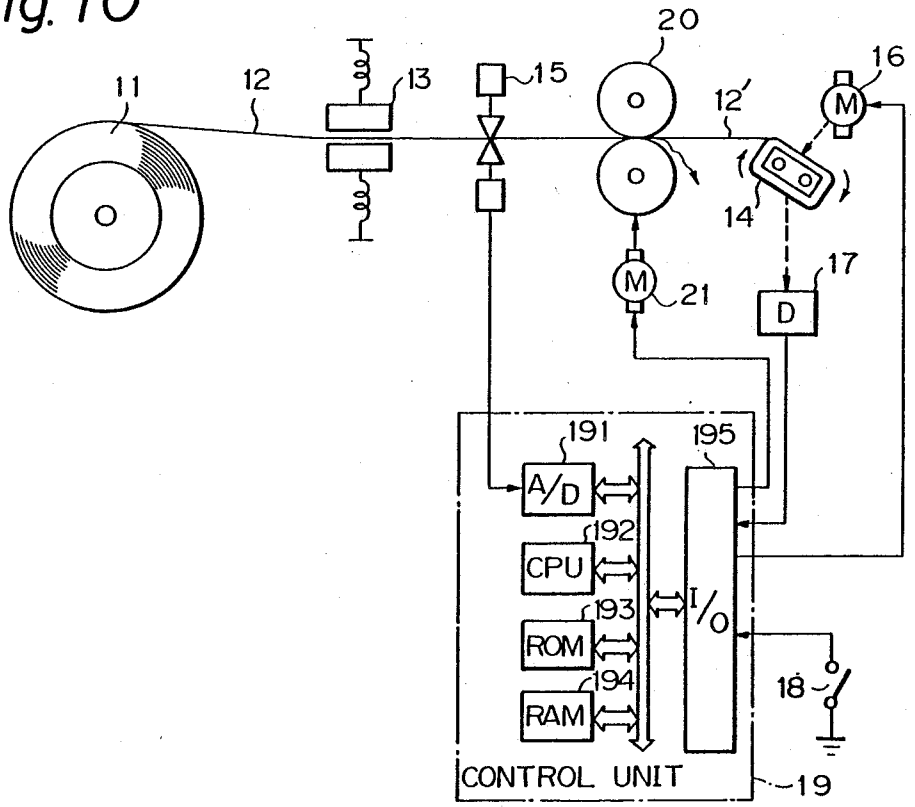
FIG. 10 is a schematic view illustrating a second embodiment of the apparatus for manufacturing a wound core according to the present invention.

In FIG. 10, which illustrates a second embodiment of the present invention, a material is cut into a strip (or strips), and simultaneously, each piece of the cut strip is wound on the winding spool 14. In FIG. 10, a slitter unit 20 provided with one or two pairs of slitter blades and a drive motor 21 is added to the elements of FIG. 7. This is because, for example, only one pair of slitter blades is necessary for cutting the material as shown in FIG. 6A, but two pairs of slitter blades are necessary for cutting the material as shown in FIG. 6B. That is, in this case, the material 12 from the material coil 11 is cut by the slitter unit 20 to form a strip 12', and then the strip 12' is wound on the winding spool 14. Therefore, for example, this embodiment is suitable for manufacturing the stepwise cross-sectional wound core of FIG. 4 and the circular cross-sectional wound core of FIG. 5. The operation of the control unit 19 is carried out by the routines of FIGS. 8 and 11.

Figure 11:
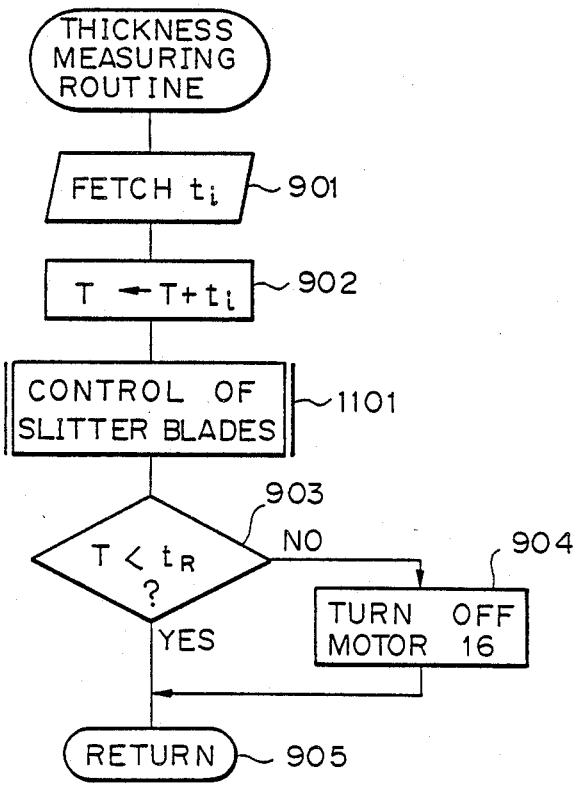
FIG. 11 is a flowchart explaining the operation of the control unit of FIG. 10.

In the routine of FIG. 11, step 1101 is added to the flow of FIG. 9. At step 1101, the traverse position of the slitter blades of the slitter unit 20 is calculated by the interpolation method from a predetermined cut curve (one-dimensional map) stored in the ROM 193, by using the summed thickness T, and as a result, the drive motor 21 is controlled in accordance with this calculated traverse position, to thereby change the positions of the slitter blades of the slitter unit 20.

Thus, according to the second embodiment of the present invention, a desired cross-sectional wound core is obtained directly from the material 12.

Note that each thickness $t_i$ is estimated by measuring running lengths $l_0, l_1, l_1, \ldots$ of the strip corresponding to a predetermined rotation of the winding spool 14. In this case, a running length meter (see: reference numeral 23 of FIG. 12) is provided instead of the rotational position detector 17.

Figure 12:
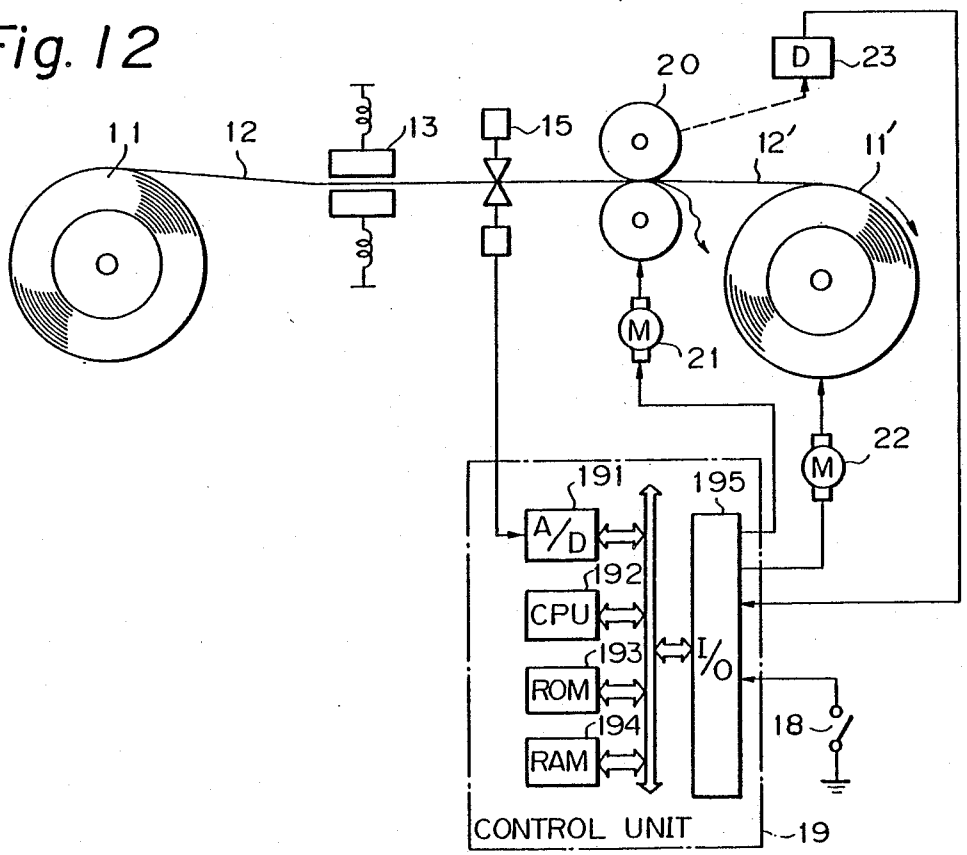
FIG. 12 is a schematic view illustrating a third embodiment of the apparatus for manufacturing a wound core according to the present invention; and, FIGS. 13, 14, and 15 are flowcharts explaining the operation of the control unit of FIG. 12.

In FIG. 12, which illustrates a third embodiment of the present invention, a material is cut into a strip (or strips) and the strip is wound on a temporary winding frame. Therefore, in FIG. 12, a temporary winding frame 11' and a drive motor 22 therefor are provided instead of the winding spool 14 and the elements 16 and 17 of FIG. 10. Also, in FIG. 12, reference 23 designates a running length meter for measuring the running length of the strip 12', which meter 23 generates a pulse signal in accordance with the rotation of the slitter blades of the slitter unit 20.

The operation of the control unit 19 of FIG. 12 will be explained with reference to the flowcharts of FIGS. 13, 14, and 15.

Figure 13:
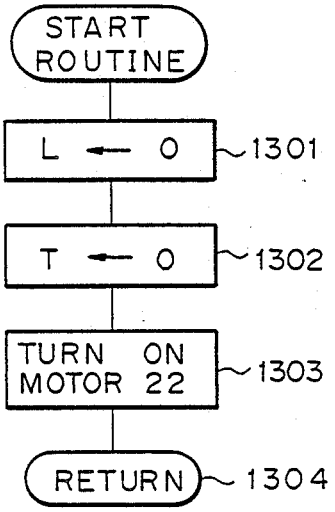

The routine of FIG. 13 is an interrupt routine which is started by turning ON the start switch 18. At step 1301, a running length count L of the total running length of the strip 12' is cleared, and at step 1302, a summed thickness T is cleared. Also, at step 1303, the drive motor 22 is turned ON, and this routine is completed at step 1304. The temporary winding frame 11' is then rotated as indicated by an arrow in FIG. 12, thus initiating the cutting of the material 12 and the winding of the strip 12'.

Figure 14:
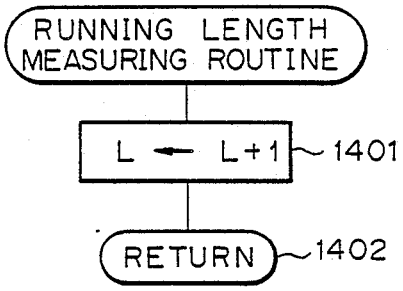

As explained above, when the cutting operation of the material 12 and the winding operation of the strip 12' are carried out, an interrupt routine of FIG. 14 is carried out every time the running length meter 23 generates a pulse signal. At step 1401, the running length count L is counted up by +1 and is then stored in the RAM 194, and this routine is completed at step 1402.

Figure 15:
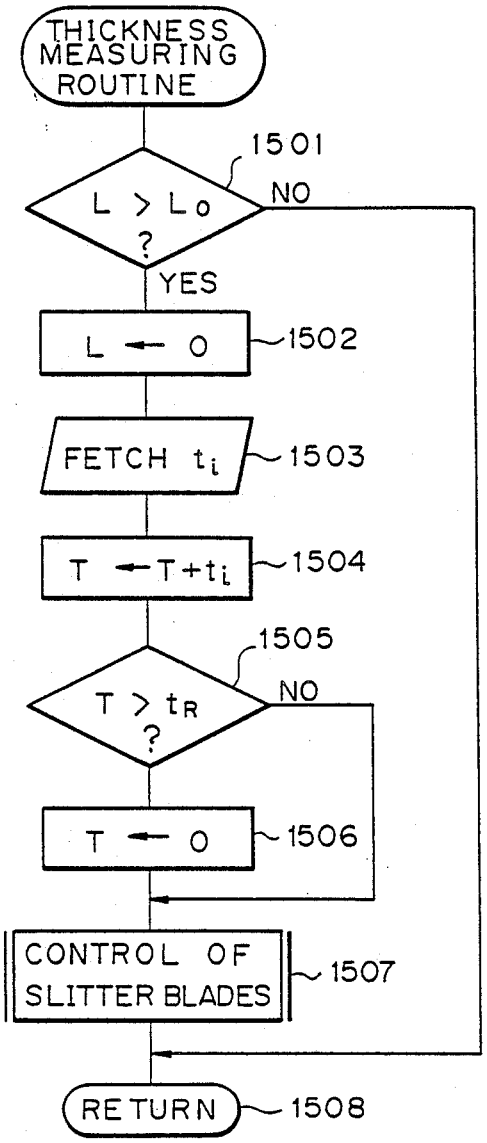

In FIG. 15, which is a thickness measuring routine executed at predetermined time periods, at step 1501, the running length count L is read out of the RAM 194, and it is determined whether or not the value thereof has reached a predetermined value $L_0$, i.e., whether or not the strip 12' has run for a predetermined length. As a result, only when the strip 12' has run for the predetermined length ($L > L_0$), does the control proceed to steps 1502 to 1507. Otherwise, the control proceeds directly to step 1508.

At step 1502, the running length count L is cleared, and then at step 1503, an A/D conversion is performed upon the output $t_i$ of the thickness meter 15, and at step 1504, the summed thickness T is renewed by $$T \leftarrow T + t_i.$$

Then, at step 1505, it is determined whether or not the summed thickness T has reached a predetermined value $t_R$. As a result, when the summed thickness T has reached the predetermined value $t_R$ ($T > t_R$), the control proceeds to step 1506 which clears the summed thickness T.

At step 1507, the traverse position of the slitter blades of the slitter unit 20 is calculated by the interpolation method from a predetermined cut curve (one-dimensional map) stored in the ROM 193, by using the summed thickness T, and the drive motor 21 is controlled in accordance with this calculated traverse position, to thereby change the positions of the slitter blades of the slitter unit 20.

Then, this routine is completed by step 1508.

Thus, the thickness $t_i$ is fetched at a predetermined length of the strip 12 (i.e. the material 12), and the cutting operation is controlled in accordance with the summed thickness T ($=\Sigma t_i$). The control for the slitter blades is repeated for each summed thickness $t_R$. Therefore, when the strip wound on the temporary winding frame 11' of FIG. 12 is wound on a winding spool as illustrated in FIG. 7, complete wound cores having a predetermined shape, such as a stepwise wound core as shown in FIG. 4 and a circular cross sectional wound core as shown in FIG. 5, are continuously obtained.

As explained above, according to the present invention, a predetermined thickness of a wound core is directly obtained without the need for subsequent processes, so that the efficiency of a winding operation of the wound core can be enhanced, and thus the cost of manufacturing transformers (wound cores) can be reduced.

Also, in the slitter unit, since the traverse position of slitter blades is controlled in accordance with the summed thickness of the strip, the cross section of a wound core is accurate, which contributes to an enhancement of the effective cross-section of wound cores, and increases the magnetic flux thereof.

I claim:

1. A method for manufacturing a wound core by winding a continuous strip, having a desired shape in the width direction thereof, on a winding spool, comprising the steps of:

measuring a thickness of said strip which is being wound on said winding tool;

summing said measured thickness of said strip at predetermined periods;

determining whether or not said summed thickness of said strip has reached a predetermined value;

stopping a winding operation by said winding spool when said summed thickness of said strip has reached said predetermined value;

preparing a material having two straight edges on sides thereof;

performing a cutting operation upon said material with slitter blades to obtain said strip;

controlling a cut-with of said slitter blades in accordance with said summed thickness of said strip.

2. A method as set forth in claim 1, further comprising a step of detecting particular rotational positions of said winding spool, said predetermined periods being determined by detecting said rotational positions of said winding spool.

3. A method as set forth in claim 1, further comprising a step of measuring a running length of said strip, said predetermined periods being determined by whether or not said running length has reached predetermined lengths.

4. A method for manufacturing a wound core, comprising the steps of:

preparing a material having two straight edges on sides thereof;

performing a cutting operation upon said material with slitter blades to obtain a continuous strip;

winding said strip on a temporary winding frame;

measuring a thickness of said material or strip to be wound on said temporary winding frame;

summing said measured thickness of said material or strip at predetermined periods;

controlling a traverse position of said slitter blades in accordance with said summed thickness of said strip;

determining whether or not said summed thickness of said material or strip has reached a predetermined value; and periodically repeating control of the traverse position of said slitter blades in said slitter blade controlling step, each pieces of said strip wound on said temporary winding frame being wound on a winding spool to obtain said wound core.

5. A method as set forth in claim 4, further comprising a step of detecting particular rotational positions of said winding spool, said predetermined periods being determined by detecting said rotational positions of said winding spool.

6. A method as set forth in claim 4, further comprising a step of measuring a running length of said strip, said predetermined periods being determined by whether or not said running length has reached predetermined lengths.

7. An apparatus for manufacturing a wound core by winding a continuous strip, having a desired shape in the width direction thereof, on a winding spool, comprising:

means for measuring a thickness of said strip which is being wound on said winding spool;

means for summing said measured thickness of said strip at predetermined periods;

means for determining whether or not said summed thickness of said strip has reached a predetermined value;

means for stopping a winding operation by said winding spool when said summed thickness of said strip has reached said predetermined value;

means for preparing a material having two straight edges on sides thereof;

means for performing a cutting operation upon said material with slitter blades to obtain said strip;

means for controlling a cut-width of said slitter blades in accordance with said summed thickness of said strip.

8. An apparatus as set forth in claim 7, further comprising means for detecting particular rotational positions of said winding spool, said predetermined periods being determined by detecting said rotational positions of said winding spool.

9. An apparatus as set forth in claim 7, further comprising means for measuring a running length of said strip, said predetermined periods being determined by whether or not said running length has reached predetermined lengths.

10. An apparatus for manufacturing a wound core, comprising:

means for preparing a material having two straight edges on sides thereof;

means for performing a cutting operation upon said material with slitter blades to obtain a continuous strip;

means for winding said strip on a temporary winding frame;

means for measuring a thickness of said material or strip to be wound on said temporary winding frame;

means for summing said measured thickness of said material or strip at predetermined periods;

means for controlling a traverse position of said slitter blades in accordance with said summed thickness of said strip;

means for determining whether or not said summed thickness of said material or strip has reached a predetermined value; and means for periodically repeating control of the traverse position of said slitter blades in said slitter blade controlling means, each piece of said strip wound on said temporary winding frame being wound on a winding spool to obtain said wound core.

11. An apparatus as set forth in claim 10, further comprising means for detecting particular rotational positions of said winding spool, said predetermined periods being determined by detecting said rotational positions of said winding spool.

12. A method as set forth in claim 10, further comprising means for measuring a running length of said strip, said predetermined periods being determined by whether or not said running length has reached predetermined lengths.

* * * * *

UNITED STATES PATENT AND TRADEMARK OFFICE

CERTIFICATE OF CORRECTION

PATENT NO. : 4,842,208

DATED : June 27, 1989

INVENTOR(S) : Fumio Kitamura

It is certified that error appears in the above-identified patent and that said Letters Patent is hereby corrected as shown below:

Column 3, line 53, "303" should be --803--;

Column 4, line 45, "$l_o$, $l_1$, $l_1$, ..." should be $\ell_o$, $\ell_1$, $\ell_1$, ...;

Column 5, line 48, "strip 12" should be --strip 12'--;

Column 6, line 9, "tool" should be --spool--;

Column 6, line 21, "cut-with" should be --cut width--;

Column 6, line 54, "pieces" should be --piece--.

Signed and Sealed this

Tenth Day of July, 1990

*Attest:*

HARRY F. MANBECK, JR.

*Attesting Officer*

*Commissioner of Patents and Trademarks*